US006958483B2

(12) United States Patent
Georgii

(10) Patent No.: US 6,958,483 B2
(45) Date of Patent: Oct. 25, 2005

(54) CONTAINER DEVICE FOR THE STORAGE OF HAZARDOUS MATERIALS AND A METHOD OF MAKING IT

(75) Inventor: Hans Georgii, London (GB)

(73) Assignee: Oyster International N.V., (AN)

( * ) Notice: Subject to any disclaimer, the term of this patent is extended or adjusted under 35 U.S.C. 154(b) by 0 days.

(21) Appl. No.: 10/499,335

(22) PCT Filed: Dec. 17, 2002

(86) PCT No.: PCT/SE02/02346

§ 371 (c)(1),
(2), (4) Date: Jun. 17, 2004

(87) PCT Pub. No.: WO03/065380

PCT Pub. Date: Aug. 7, 2003

(65) Prior Publication Data

US 2005/0077487 A1 Apr. 14, 2005

(30) Foreign Application Priority Data

Dec. 18, 2001 (SE) ..... 0104263

(51) Int. Cl.[7] ..... G21F 5/00

(52) U.S. Cl. ..... 250/506.1; 250/507.1; 250/515.1; 250/518.1; 376/272

(58) Field of Search ..... 250/506.1, 507.1, 250/515.1; 376/272

(56) References Cited

U.S. PATENT DOCUMENTS 4,877,969 A 10/1989 James et al.
6,825,483 B2 * 11/2004 Nicholson et al. ..... 250/507.1

FOREIGN PATENT DOCUMENTS

DE 2300620 7/1974
WO WO 01/78084 10/2001

* cited by examiner

*Primary Examiner*—Nikita Wells
*Assistant Examiner*—Zia R. Hashmi
(74) *Attorney, Agent, or Firm*—Douglas E. Jackson; Stites & Harbison, PLLC

(57) ABSTRACT

A container device (10) for storing hazardous material comprises a substantially cylindrical container block which has a central axial cylindrical through passage (13) and includes a group of storage vessels (12) for the hazardous material positioned between the central passage and the circumferential surface of the container block and which further includes a cylindrical concrete body (14) enveloping the group of storage vessels. The storage vessels (12) are positioned adjacent to one another along a closed curve, and sections of the circumferential surfaces of adjacent storage vessels (12) form the predominant part of the wall of the central passage (13). The concrete body directly contacts the storage vessels (12) over substantially all the parts of said circumferential surfaces, which do not constitute said sections. When the container device is made, the remaining parts of the circumferential surfaces of the storage vessels (12) form a permanent formwork in which the concrete body (14) is cast.

13 Claims, 4 Drawing Sheets

CONTAINER DEVICE FOR THE STORAGE OF HAZARDOUS MATERIALS AND A METHOD OF MAKING IT

The invention relates to a container device for storing hazardous material, especially a heat generating material, such as radioactive fuel for nuclear reactors. More particularly, the invention relates to a device comprising a substantially cylindrical container block which has a central axial through passage and includes a group of storage vessels for the hazardous material positioned between the central passage and the circumferential surface of the container block and which further includes a cylindrical concrete body enveloping the group of storage vessels.

WO01/78082, WO01/78083 and WO01/78084 show examples of known embodiments of such devices. The central axial passage serves as a central wide cooling passage through which air or other fluid coolant may flow by natural convection (chimney or stack effect) or, when the demand for cooling is great, with assistance of a fan or pump unit. Heat transported outwardly from the hazardous material through the enveloping concrete body to the circumferential surface may be dissipated to the ambient medium by a coolant, such as air or water, flowing along the circumferential surface.

In the embodiments known from these documents, the storage vessels for the hazardous material are completely embedded in the concrete body. Accordingly, a concrete layer providing, among other things, a mechanical protection for the storage vessels, is disposed between the central axial passage and the storage vessels, which may be made of steel sheet, for example, and are distributed around the passage.

WO01/78084 describes, in addition to a storage device of the kind mentioned above, a method and an installation for manufacturing such storage devices. The manufacture includes erection of concrete casting formwork which is placed in an underwater position in a casting basin, whereupon storage vessels containing the hazardous material and constantly kept under water are transferred to and placed in the formwork, and concrete is placed in the underwater formwork so that the storage vessels become completely embedded in the concrete. When the concrete has set sufficiently, the formwork with the concrete body formed therein is taken out of the casting basin. In an alternative embodiment, the storage vessels are mounted in the formwork before the formwork is placed in the casting basin, whereupon the hazardous material is introduced in the storage vessels, likewise always in an underwater position, and after the storage vessels have been sealed, the formwork is filled with concrete so that the storage vessels become embedded in a concrete body.

This invention is a further development of the above-described container device and the method of making it.

In accordance with the invention prefabricated storage vessels of concrete are used for holding the hazardous material, which may be contained in an inner vessel. The storage vessels are positioned such that parts of their circumferential surfaces jointly form the central passage while other parts of the circumferential surfaces form permanent formwork for the concrete body.

A container device of this construction can be made in a simple and efficient manner and still provide for adequate dissipation of heat and protection of the hazardous material or an inner vessel containing the hazardous material.

The making of the container device in accordance with the invention comprises placing a formwork section which comprises a bottom part having as central opening and further comprises a cylindrical circumferential jacket on a casting bed, placing a group of cylindrical storage containers, which have approximately the same height as the jacket and form compartments for holding the hazardous material, in upright position adjacent to one another on the bottom part of the formwork section adjacent to and around the central opening, so that the group of storage containers defined a cylindrical cavity jointly with the jacket, the bottom part of the formwork section and, if required, also wall elements bridging gaps between the storage containers, filling the cylindrical cavity with concrete, and mounting on top of the jacket and the group of storage vessels a top end plate having a central opening corresponding to the opening in the bottom part. The mounting of the top end plate may take place before or after the placing of the concrete. In the latter case, the concrete can be introduced through holes in the upper end plate.

Before the placing of the concrete, it may be advantageous to attach upstanding reinforcing bars in the formwork section and secure their upper ends to the top end plate when the latter is mounted. The reinforcing bars, which may be prestressed if desired, may also sever as anchors for lifting loops or other devices for attaching hoisting devices to the container device.

The invention will be described more fully below with reference to the drawings.

Figure 1:
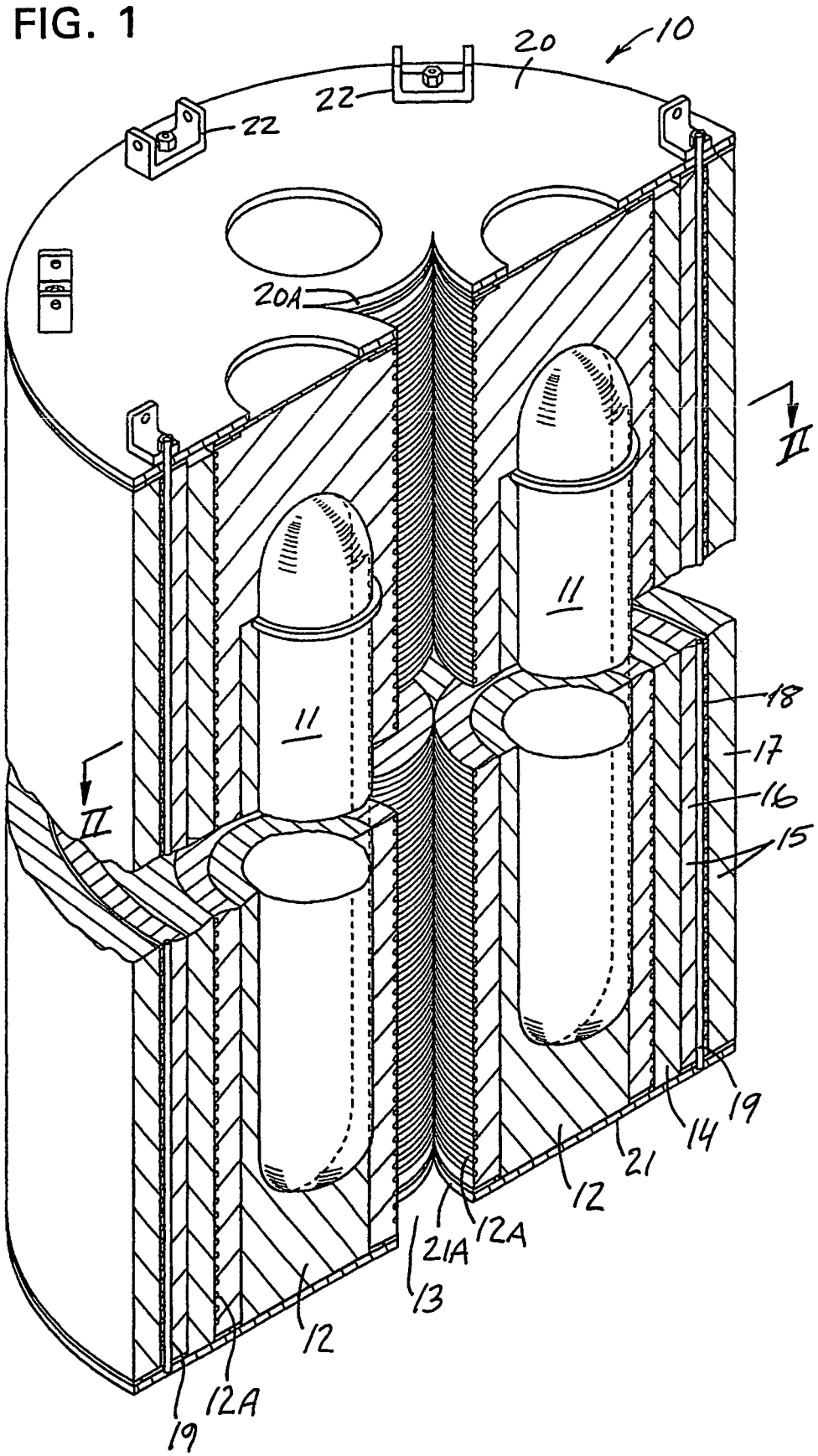
FIG. 1 is a perspective view in vertical section of an embodiment of a container device according to the invention.
Figure 2:
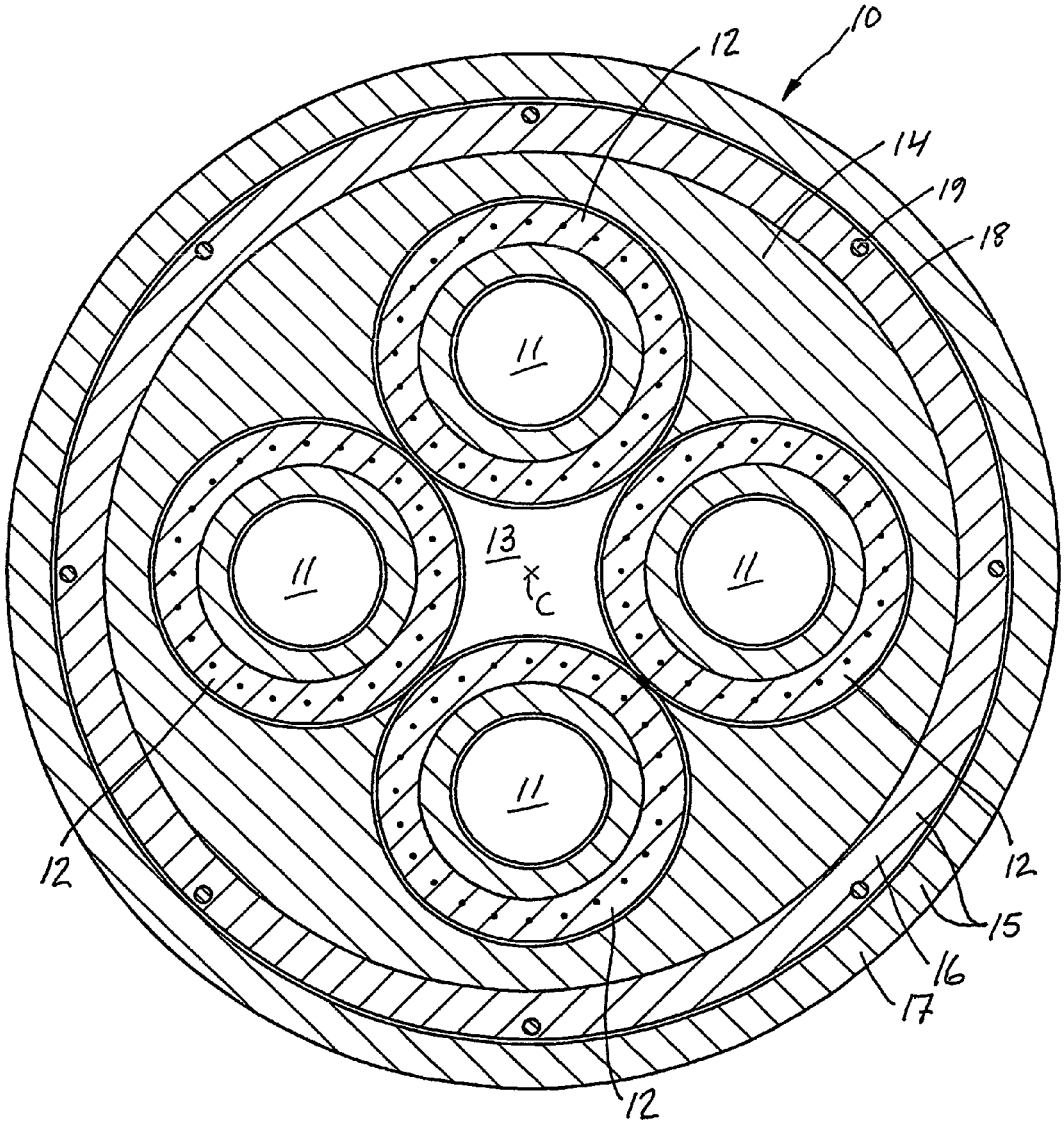
FIG. 2 is a horizontal sectional view of the container device of FIG. 1.

The container device 10 illustrated in FIGS. 1 and 2 is adapted to hold four elongate, hermetically sealed capsules or inner vessels 11 containing hazardous material, especially spent nuclear fuel, e.g. in the form of fuel assemblies or bundles of fuel rods (not shown). In the illustrated embodiment, the inner vessels 11 are substantially circular cylindrical, apart from their ends, which are rounded, and made of metal, such as stainless steel. They may also be made of a different material suited to the nature of the hazardous material they are meant to hold. Since the detailed construction of the inner vessels forms no part of the invention, it will not be shown and described.

Generally, the container device 10 as a whole is in the shape of a straight circular cylinder, the diameter and height of which are determined by the use. In the exemplary case of use, that is, when the nuclear fuel is fuel assemblies or bundles of fuel rods, the diameter and height may be, for example, 3 to 3.5 m and about 6 m, respectively.

In the central part thereof, the container device 10 includes a group of four circular cylindrical storage vessels, also called intermediate containers in this description, and designated by 12, which are sealed in a manner to be descried, each of them holding one of the inner vessels 11. Their heights are almost the same as the height of the entire container device. The intermediate containers 12 are positioned such that their vertical axes are all positioned on an imaginary upstanding cylinder the axis C of which (FIG. 2) forms, or coincides with, the axis of the entire container device.

Moreover, the intermediate containers 12 are positioned very close to or in engagement with one another, so that sections of their circumferential surfaces jointly define a central, cylindrical vertical passage 13, the sides of which are convex as seen from the axis C. If the intermediate containers 12 are not in direct engagement with one another, the gaps separating them may be filled with suitable elements, such as sealing strips of some suitable material. It is also within the scope of the invention to have wider gaps between the intermediate containers 12. In that case, the gaps separating the containers should be bridged and closed by a wall member (not shown), such as at or near the narrowest section of the separating gap. Sections of the circumferential surfaces of the containers 12 and the bridging wall members will then define the central passage 13. However, it is important that the main portion of the passage 13 be defined by sections of the circumferential surfaces of the intermediate containers (storage vessels) 12.

The intermediate vessels 12 are made of high-quality concrete and are radially prestressed by a steel reinforcement 12A wound about the circumferential surface. It is also within the scope of the invention to make the intermediate containers reinforced and, if desired, prestressed axially, but this is not shown in detail in the drawing; however, in the cross-sectional view in FIG. 2, axial reinforcing members are indicated by dots. They are also provided with elements (not shown) for the attachment of lifting yokes or other hoisting aids.

An externally circular cylindrical concrete body 14, the height of which is substantially the same as that of the intermediate containers 12, envelops the group of intermediate containers 12 on their sides. The concrete body 14, in turn, is enveloped throughout the height thereof by a circular cylindrical jacket 15, formed, in the illustrated embodiment, by an inner, reinforced jacket member 16 and an outer jacket member 17, which snugly envelopes the inner jacket member and may or may not be reinforced. The inner jacket member 16 is provided with a stressed wire reinforcement 18 wound about the circumferential surface thereof, and also with an axial reinforcement formed by reinforcing bars 19.

As shown in FIGS. 1 and 2, the concrete body 14 completely fills the cavity between the group of intermediate containers 12 and the inner side of the inner jacket member 16. The concrete in the concrete body 14 contacts the outer section of the circumferential surface of each intermediate container 12, i.e. the section of that surface which is remote from the central passage 13; that section is substantially larger than one-half of the entire circumferential surface.

Circular ends plates 20 and 21 of heavy steel sheet cover the end faces of the body that is formed by the group of intermediate containers 12, the concrete body 14 and the jacket 15. These end plates are formed with a central opening 20A and 21A, respectively, which is congruent with and registers with the central passage 13 formed by the intermediate containers so that it forms an extension of that passage. In the upper end plate 20 there are also circular openings 20B opposite to each intermediate container 12. Moreover, on this end plate a number of lifting eyes 22 are provided which are used for attachment of lifting yokes or other hoisting aids when the container device 10 is to be lifted. These lifting eyes are secured to the reinforcing bars 19.

In the process of making the container device 10, the intermediate containers 12, the jacket 15 and the end plates 20, 21 are prefabricated components. The lower end plate 21 is placed on a suitable casting bed, preferably in a water basin as will be described in greater detail below with reference to FIG. 3. Then the jacket 15 is placed on the end plate 21 to form therewith a formwork section, which is open upwards. The lower ends of the reinforcing bars 19 in the inner jacket section 16 are anchored in the end plate. The group of sealed intermediate containers 12 are placed in their proper positions adjacent to the central opening 21A of the lower end plate. If necessary, sealing members or wall elements (not shown) are placed between the intermediate containers 12 at the locations where these are close to one another so that a coherent cylindrical surface is formed to define the central passage 13. Then concrete is placed in the cavity between, on the one hand, the group of intermediate containers 12 and any sealing members or wall elements placed between these and, on the other hand, the inner side of the inner jacket section 16 to form the concrete body 14. Placing of the concrete suitably is effected such that the concrete fills the cavity from the bottom and upwards. The upper end plate is positioned on a thinner intermediate plate and secured to the upper end of the reinforcing bars 19. Alternatively, the upper end plate 20 is mounted prior to the placing of the concrete. In that case, the cavity in which the concrete body 14 is formed is filled through openings in the upper end plate 20.

Figure 3:
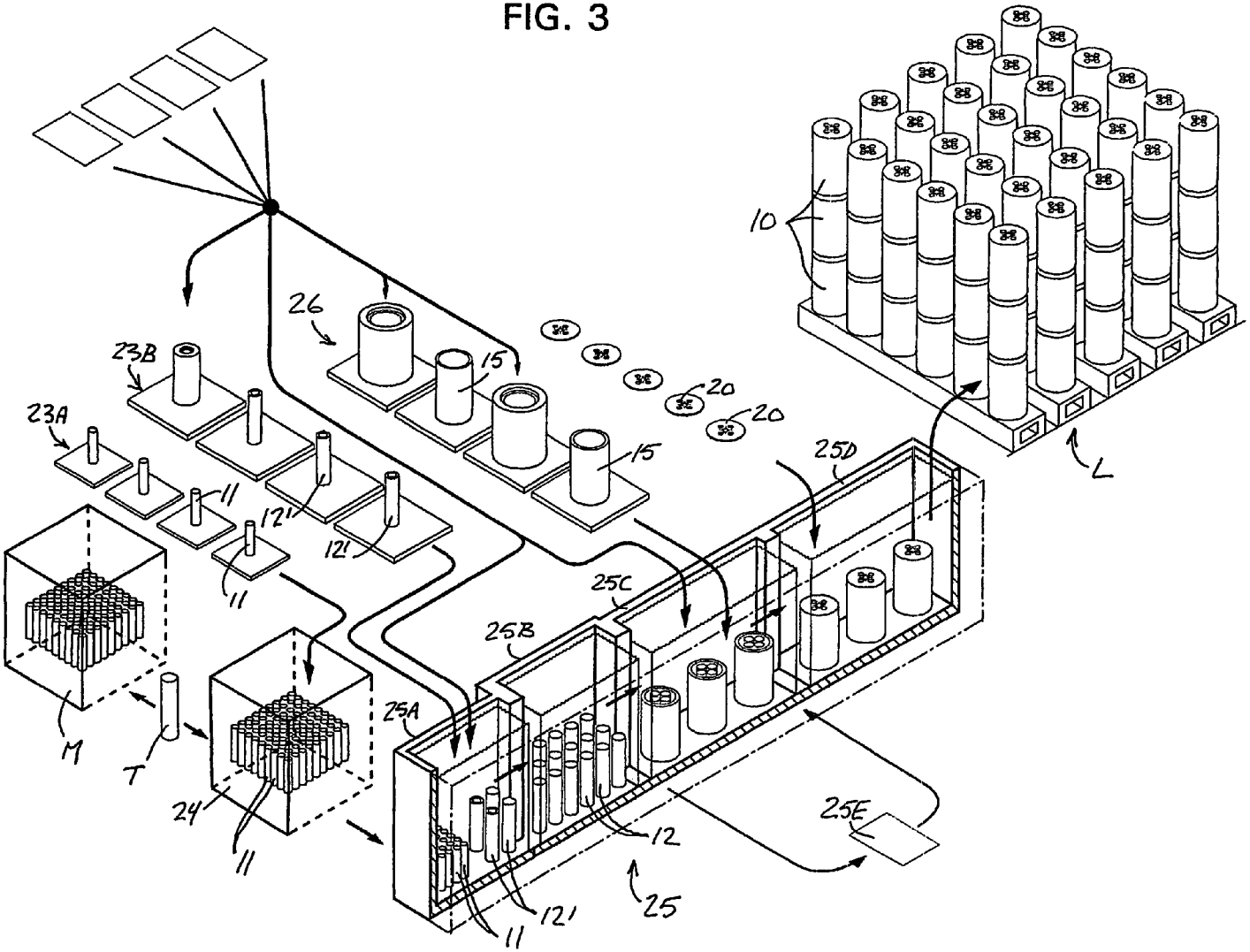
FIG. 3 is a perspective view, partly in section, of an installation for making the container device of FIGS. 1 and 2.

When the container device 10 is finished, it is moved to a storage location designated by L in FIG. 3.

FIG. 3 is a more detailed but still diagrammatic view of an example of a method and an installation for making container devices 10 in accordance with the brief description above. In an intermediate storage M, spent nuclear fuel F in the form of fuel assemblies or fuel rod bundles is stored under water in a pool. From a production station 23A or other source, still open inner vessels 11 are transferred to a basin 24 where they are placed under water. From the intermediate storage M the fuel F is transferred in shipping containers T to the basin 24 where it is introduced in the inner vessels 11 which are then sealed hermetically.

From a production station 23B or other source still open intermediate containers 12 are transferred to a basin system 25 with a charging station formed by a basin section 25A of the basin system. The sealed inner vessels 11 are moved to this charging station where they are transferred, still under water, into an intermediate container 12, one inner vessel in each intermediate container, whereupon the intermediate containers 12 are sealed with concrete so that the inner vessels 11 will be completely embedded in concrete (as will be described in greater detail below).

Then the finished, sealed intermediate containers 12 with the inner vessels 11 enclosed therein are moved to a basin section 25B of the basin system 25 where they are placed under water in a buffer supply of sealed intermediate storage containers.

From a different production station 26 or other source, jackets 15 are transferred to a concrete placing basin section 25C of the basin system 25 where they are placed under water on a casting bed formed by the previously positioned lower end plate 21, in which the reinforcing bars 19 are then anchored. The four sealed intermediate containers 12, which are moved from the basin section 25, all the time held completely immersed in the water, are placed around the central opening 21A in the end plate 21. Naturally, the intermediate containers 12 can be placed on the end plate 21 before the jacket is positioned thereon. If necessary, sealing members or wall elements are inserted between the intermediate containers 12 where these are closest to one another.

Then the formwork formed by lower end plate 21, the jacket 15 and the group of intermediate containers 12, where applicable also sealing members or wall elements, is filled with concrete to form the concrete body 14. This formwork with the still soft concrete body 14 is moved to a fourth basin section 25D in the basin system 25 where the upper end plate is mounted and possibly other finishing operations are performed.

The finished container devices 10 are then transferred to the storage L where they are stacked such that air can flow along the outer side of the stacks and also through the "flues" formed by the aligned central passages 13 in the stacks.

In the basin system 25, the water circulates in a circuit that includes a purifying system 25E.

In a modification, not shown, of the method illustrated in FIG. 3, a formwork section, which has been assembled outside the basin system 25 and comprises a bottom part which is formed by or corresponds to the end plate 21, and a wall, which is formed by or corresponds to the jacket 15, is placed in the concrete placing section 25C. Then the intermediate containers 12 are placed in this formwork section as described above, whereupon the concrete placing takes place and the upper end plate 20 is mounted.

Figures 4A, 4B, 4C:
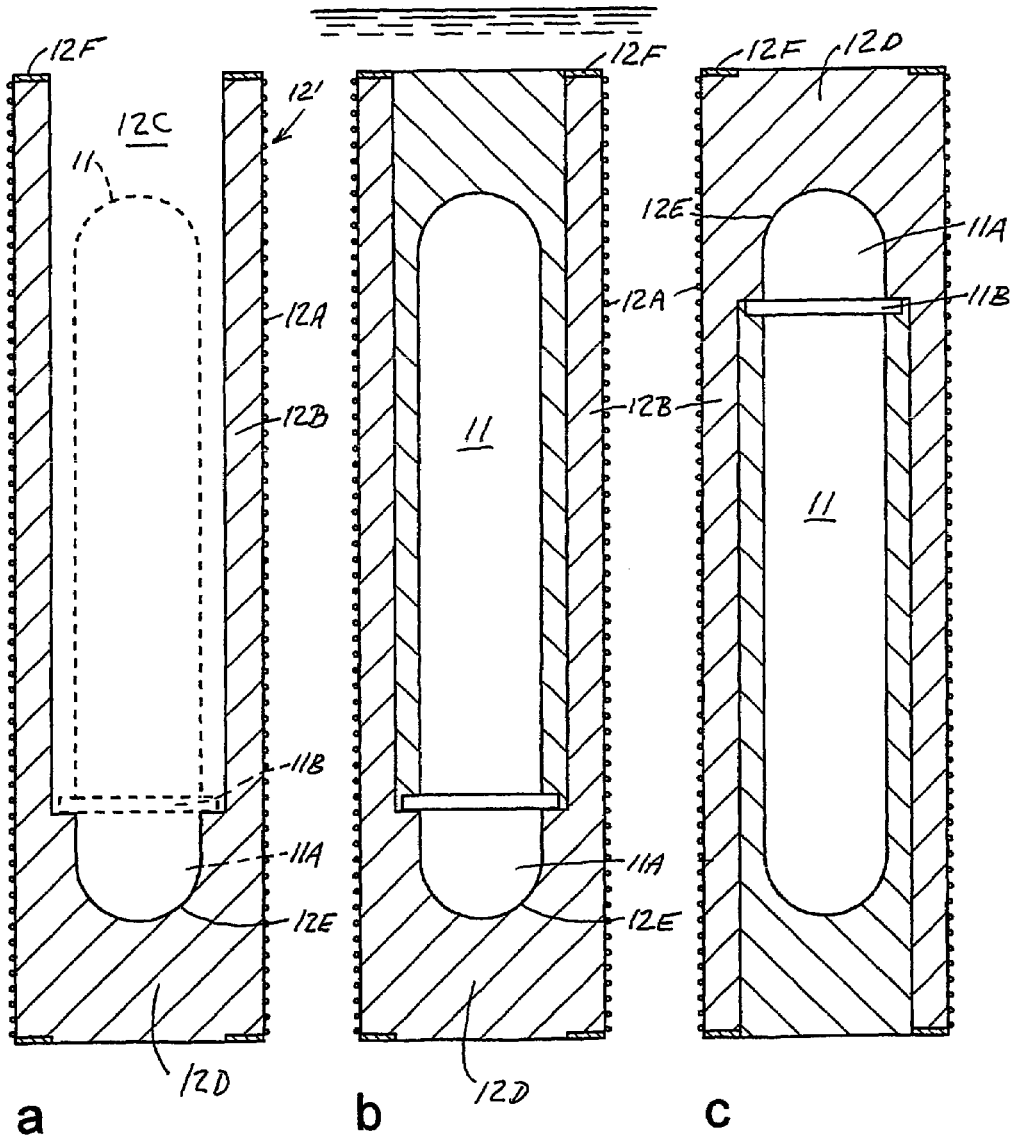
FIGS. 4A, 4B and 4C are sectional views showing successive steps in the making of a closed storage vessel forming part of the container device.

FIGS. 4A, 4B and 4C show steps of the operations carried out in the charging station 25A.

"Semi-products" 12' of the intermediate containers 12 formed by the storage vessels are delivered to the charging station formed by the basin section 25A. The design of these "semi-products" is apparent from FIG. 4A, where the outline of an inner vessel 11 is shown. The semi-product is in the shape of a circular cylindrical pot 12B of concrete. This pot defines a generally circular cylindrical storage compartment for holding the hazardous material. The bottom 12D of the pot is relatively thick and has a central recess 12E in which an end of the inner vessel 11 fits. At the ends of the pot there is an annular sheet metal disc 12F. The inner vessel 11 is inserted in the recess and thus held in a centred position in the pot 12B. The insertion is carried out with the inner vessel 11 turned upside down, that is, with a cover member 11A directed downwards; the cover member is detachably joined with the main body of the inner vessel at a flange 11B.

In FIG. 4B, the pot 12B is shown in a sealed state with the parts of the storage compartment 12C left between the inner side and the inner vessel 11 and above the inner vessel filled with concrete. In FIG. 4C the finished intermediate container 12 is shown turned upside down with respect to the position shown in FIG. 4B, that is, with the inner vessel now standing with the cover member 11A at the top end.

The containment of the inner vessel 11 in the storage or intermediate container 12 as shown in FIGS. 4A–C by embedding the inner vessel in concrete in the intermediate container 12 ensures a very high degree of safety against leakage from the inner vessel to the environment. It is within the scope of the invention, however, to seal the intermediate container in a different way, such as by means of a separate cover or other closure member.

It is also possible to use the intermediate containers 12 as shipping containers, e.g. for the shipping containers T. In that case they are adapted to be closed in a manner such that they can readily be reopened for withdrawal of the hazardous material. When used as shipping containers they are preferably provided with a jacket of steel.

What is claimed is:

1. A container device for storing hazardous material, especially a heat generating material, such as radioactive fuel for nuclear reactors, comprising a substantially cylindrical container block which has a central axial cylindrical through passage and includes a group of storage vessels for the hazardous material positioned between the central passage and the circumferential surface of the container block and which further includes a cylindrical concrete body enveloping the group of storage vessels, characterized in that the storage vessels are positioned adjacent to one another along a closed curve, in that the wall of the central passage is formed predominantly by sections of the circumferential surfaces of adjacent storage vessels and in that the concrete body directly contacts the storage vessels over substantially all the parts of said circumferential surfaces which do not constitute said sections.

2. A device according to claim 1, characterized in that the storage vessels are adapted to hold inner vessels containing the hazardous material.

3. A device according to claim 1, characterized in that the storage vessels are cylindrical and made of concrete and preferably include a peripheral wire reinforcement and/or an axial reinforcement.

4. A device according to claim 3, characterized in that the storage vessels are adapted to be sealed by filling concrete in storage compartments therein.

5. A device according to claim 1, characterized in that the storage vessels have storage compartments including means for positioning inner vessels containing the hazardous material.

6. A device according to claim 1, characterized in that the circumferential surface of the concrete body is enveloped by a concrete jacket member and, optionally, an outer concrete jacket member enveloping the first-mentioned jacket member.

7. A device according to claim 6, characterized in that the jacket member is reinforced by a plurality of axial reinforcing rods.

8. A device according to claim 6, characterized in that the concrete jacket member comprises a peripheral wire reinforcement.

9. A device according to claim 1, characterized by upper and lower end members having openings of a size and a shape substantially corresponding to the cross-section of the central passage and covering respectively the upper and the lower end of the group of storage vessels and of the concrete body.

10. A device according to claim 9, characterized in that the end members also cover the jacket member and in that the reinforcing rods are anchored in the end members.

11. A method of making a container device for storing hazardous material, especially a heat generating material, such as radioactive nuclear fuel, characterized by placing a formwork section which comprises a bottom part having a central opening and which further comprises a cylindrical jacket on a casting bed, placing a group of cylindrical storage containers, which have approximately the same height as the jacket of the formwork section and form compartments for holding the hazardous material in an upright position adjacent to one another on the bottom part of the formwork section adjacent to and around the central opening, so that the group of storage containers define a cylindrical cavity jointly with the jacket, the bottom part of the formwork section and, if required, also wall elements bridging gaps between the storage containers, filling the cylindrical cavity with concrete to form the concrete body, and mounting an upper end plate having a central opening corresponding to the central opening of the lower end plate on top of the jacket and the group of storage vessels.

12. A method as claimed in claim 11, characterized by sealing the storage vessels with the hazardous material introduced therein, preferably by filling concrete in the compartment receiving the hazardous material, before the storage vessels are placed on the bottom part of the formwork section.

13. A method as claimed in claim 12, characterized in that the introduction of the hazardous material in the storage containers, the placing of the storage containers with the hazardous material introduced therein in the formwork section and the filling of the cylindrical cavity with concrete to form the concrete body is carried out under water.

* * * * *